US011521777B2

(12) United States Patent
Sun et al.

(10) Patent No.: US 11,521,777 B2
(45) Date of Patent: Dec. 6, 2022

(54) DEMAGNETIZATION METHOD FOR MULTILAYER SHIELDING APPARATUS

(71) Applicant: HARBIN INSTITUTE OF TECHNOLOGY, Harbin (CN)

(72) Inventors: Zhiyin Sun, Harbin (CN); Liyi Li, Harbin (CN); Donghua Pan, Harbin (CN); Kai Song, Harbin (CN); Yuxi Liu, Harbin (CN); Yinxi Jin, Harbin (CN); Zhilong Zou, Harbin (CN)

(73) Assignee: HARBIN INSTITUTE OF TECHNOLOGY, Harbin (CN)

( * ) Notice: Subject to any disclaimer, the term of this patent is extended or adjusted under 35 U.S.C. 154(b) by 0 days.

(21) Appl. No.: 17/699,240

(22) Filed: Mar. 21, 2022

(65) Prior Publication Data

US 2022/0336136 A1 Oct. 20, 2022

Related U.S. Application Data

(63) Continuation of application No. PCT/CN2020/132573, filed on Nov. 30, 2020.

(30) Foreign Application Priority Data

Dec. 25, 2019 (CN) ..... 201911356805.9

(51) Int. Cl.
*H01F 13/00* (2006.01)

(52) U.S. Cl.
CPC ..... *H01F 13/006* (2013.01)

(58) Field of Classification Search
CPC ..... H01F 13/006; H05K 9/0075
See application file for complete search history.

(56) References Cited

U.S. PATENT DOCUMENTS

| | | | |
|---|---|---|---|
| 8,441,330 | B2 | 5/2013 | Uchaykin |
| 2015/0033546 | A1 | 2/2015 | Uchida |

FOREIGN PATENT DOCUMENTS

| | | | |
|---|---|---|---|
| CN | 103477285 | A | 12/2013 |
| CN | 109003777 | A | 12/2018 |
| CN | 109411181 | A | 3/2019 |
| CN | 110970191 | A | 4/2020 |

OTHER PUBLICATIONS

Internation Search Report of PCT/CN2020/132573, dated Feb. 25, 2021.

*Primary Examiner* — Ramon M Barrera

(57) ABSTRACT

A demagnetization method for a multilayer shielding apparatus is provided. In the demagnetization method, the demagnetization is realized on the basis of a demagnetization coil system. The demagnetization coil system includes a plurality of turns of demagnetization coils (2), a plurality of connection wires and a power supply module. The multilayer shielding apparatus includes at least two layers of shielding bodies (1); all the layers of shielding bodies (1) are sleeved layer by layer from inside to outside; a plurality of turns of demagnetization coils (2) are wound on each layer of shielding bodies (1) at intervals; and one half of each turn of demagnetization coils (2) is located inside the wound shielding bodies (1), and the other half is located outside the wound shielding bodies (1). Each demagnetization coil (2) is connected to the power supply module through the corresponding connection wire.

10 Claims, 13 Drawing Sheets

DEMAGNETIZATION METHOD FOR MULTILAYER SHIELDING APPARATUS

CROSS-REFERENCE TO RELATED APPLICATIONS

This application is a continuation of International Patent Application No. PCT/CN2020/132573 with a filing date of Nov. 30, 2020, designating the United States, now pending, and further claims priority to Chinese Patent Application No. 201911356805.9 with a filing date of Dec. 25, 2019. The content of the aforementioned applications, including any intervening amendments thereto, are incorporated herein by reference.

TECHNICAL FIELD

The present invention relates to the technical field of magnetic shielding, in particular to a demagnetization method for a multilayer shielding apparatus.

BACKGROUND OF THE PRESENT INVENTION

A shielding apparatus can shield the external geomagnetic field and the environmental interference magnetic field, to provide a magnetic field environment with extremely weak absolute magnetic field. The application of shielding apparatus is required by the development in aerospace engineering, national defense industry, space science, life science, basic physics and other directions. With the development of research, the requirements on the internal magnetic field environment of shielding apparatus have been continuously improved in recent years.

The residual static magnetic field in the shielding apparatus is a direct index to measure a degree that the near-zero magnetic field is close to the true-zero magnetic field, which is expressed by the amplitude of static magnetic induction intensity in the inner space of the device. Shielding bodies are usually made of shielding materials with high magnetic permeability (such as permalloy materials), which means that the shielding materials are magnetized while the external magnetic field is shielded. The participating magnetic fields after the external static magnetic field is shielded and the own magnetic field of the materials jointly determine the strength of the residual static magnetic field. To eliminate/weaken the magnetization intensity of the materials, the shielding materials must be demagnetized.

Therefore, a demagnetization coil system is designed for many shielding apparatuses, to optimize the residual static magnetic fields inside the shielding apparatus through demagnetization. At present, the demagnetization coil system of a multilayer shielding apparatus is generally configured in such a manner that each demagnetization coil is wound by penetrating through all layers of shielding bodies; and the demagnetization current is simultaneously applied to all demagnetization coils during demagnetization to uniformly demagnetize all layers of shielding bodies. The disadvantage is that different sizes of shielding bodies from the inner layer to the outer layer correspond to different magnitudes of demagnetization current corresponding to the saturated magnetic field required for demagnetization. When the demagnetization coil winds all the shielding bodies and only uses the same demagnetization current, or the shielding bodies in the outer layer cannot be saturated (the shielding bodies in the outer layer are saturated), or the shielding bodies in the inner layer are supersaturated (the shielding bodies in the outer layer are saturated), the shielding materials in different layers will undergo different demagnetization curves in a given demagnetization cycle, thereby failing to realize complete demagnetization. In addition, the demagnetization coils in different layers and directions will interfere with each other. For example, the demagnetization current in the outer layer will cause an interfering magnetic field to the shielding bodies in the inner layer; and the demagnetization in the direction X will an interfering magnetic field in the direction Z. However, the problem of controlling the demagnetization time sequence is not considered in the existing demagnetization coil system, which will affect the final demagnetization effect of the demagnetization coil system and the use effect of the shielding apparatus.

SUMMARY OF PRESENT INVENTION

The purpose of the present invention is to provide a demagnetization method for a multilayer shielding apparatus based on at least part of the above defects, so as to solve the problem that the multilayer shielding apparatus is difficult to realize complete demagnetization in the prior art.

To achieve the above purpose, the present invention provides a demagnetization method for a multilayer shielding apparatus; and in the demagnetization method, the demagnetization is realized on the basis of a demagnetization coil system, which comprises a plurality of turns of demagnetization coils, a plurality of connection wires and a power supply module.

The multilayer shielding apparatus comprises at least two layers of shielding bodies, wherein all the layers of shielding bodies are sleeved layer by layer from inside to outside; a plurality of turns of demagnetization coils are wound on each layer of shielding bodies at intervals; and one half of each turn of demagnetization coils is located inside the wound shielding bodies, and the other half is located outside the wound shielding bodies, for providing corresponding demagnetizing magnetic fields to form a closed magnetic flux circuit. Each demagnetization coil is connected to the power supply module through the corresponding connection wire. The power supply module comprises a controller which is connected with each connection wire and used for generating and sending corresponding control instructions according to user input to control each demagnetization coil to be applied with a corresponding demagnetization current.

The demagnetization method comprises: applying a corresponding demagnetization current to each demagnetization coil, so that all layers of shielding bodies are demagnetized layer by layer from inside to outside, and then demagnetized layer by layer from outside to inside, wherein the intensity of demagnetization current is set according to the size of each layer of shielding bodies.

Preferably, the demagnetization current applied to the demagnetization coil is linear attenuation demagnetization current, second-order attenuation demagnetization current or exponential attenuation demagnetization current.

Preferably, the envelope function expression of the linear attenuation demagnetization current is:

$$I_E = I_M\left(1 - \frac{tf_D}{n}\right),$$

where $I_M$ refers to a demagnetization current that allows the demagnetizing magnetic field in the direction to be saturated; $f_D$ refers to an alternating current frequency; and n refers to the number of alternating cycles.

The envelope function expression of the second-order attenuation demagnetization current is:

$$I_E = I_M\left(\frac{tf_D}{n} - 1\right)^2,$$

where $I_M$ refers to the demagnetization current that allows the demagnetizing magnetic field in the direction to be saturated; $f_D$ refers to the alternating current frequency; and n refers to the number of alternating cycles.

The envelope function expression of the exponential attenuation demagnetization current is:

$$I_E = I_M e^{-b\frac{tf_D}{n}},$$

where $I_M$ refers to a demagnetization current that allows the demagnetizing magnetic field in the direction to be saturated; $f_D$ refers to an alternating current frequency; n refers to the number of alternating cycles; and b refers to an adjustment parameter for adjusting the decreasing speed of exponential attenuation.

The current intensity expression of the demagnetization current applied to the demagnetization coil is:

$$I=I_E \sin(2\pi f_D t).$$

Preferably, a plurality of turns of demagnetization coils are uniformly wound on each shielding surface of each layer of shielding bodies at intervals.

Preferably, each connection wire is folded back; one half of each connection wire is a current outgoing circuit connection wire, which is connected with each corresponding demagnetization coil; the other half is a current returning circuit connection wire, which is folded back along the original circuit in reverse; and both the current outgoing circuit connection wire and the current returning circuit connection wire are connected to the power supply module, so that the demagnetization current can be applied to all the connected demagnetization coils.

Preferably, the control instruction generated by the controller comprises a digital waveform corresponding to the demagnetization current.

The power supply module further comprises:

a digital-to-analog (D/A) converter, which is connected with the controller and used for receiving the digital waveform and converting the digital waveform into an analog signal;

a voltage divider, which is connected with the D/A converter and used for receiving the analog signal and adjusting the amplitude of the analog signal;

a low-pass filter, which is connected with the voltage divider and used for receiving the analog signal with adjusted amplitude and filtering a high-frequency interference signal therein;

a power amplifier, which is connected with the low-pass filter and used for receiving the filtered analog signal and outputting a high-power demagnetization current;

a transformer, which is connected with the power amplifier and used for receiving the high-power demagnetization current and filtering direct-current (DC) bias of the demagnetization current; and a relay, which is connected with the transformer and the connection wires and used for controlling an on-off state of the corresponding demagnetization coil.

Preferably, each shielding body is of a hollow cuboid structure with six planar shielding surfaces, on which a plurality of turns of demagnetization coils are uniformly wound at intervals; all turns of demagnetization coils wound on four planar shielding surfaces arranged along any direction are distributed in parallel at intervals to form a magnetic flux circuit corresponding to the direction; and the corresponding demagnetization coils on the six planar shielding surfaces form a magnetic flux circuit with three orthogonal directions.

Preferably, the demagnetization method further comprises:

applying corresponding demagnetization current to each demagnetization coil, so that each layer of shielding bodies are demagnetized simultaneously in three directions.

Preferably, each shielding body is of a hollow cuboid structure with six planar shielding surfaces; the demagnetization coil is wound around an intersection of two planar shielding surfaces of the shielding body; one turn of the demagnetization coil is arranged at any intersection of two planar shielding surfaces; all turns of demagnetization coils wound at the intersection of four planar shielding surfaces arranged in any direction are distributed in parallel at intervals to form a magnetic flux circuit corresponding to the direction; and the corresponding demagnetization coils on the six planar shielding surfaces form a magnetic flux circuit with three orthogonal directions.

Preferably, the demagnetization method further comprises:

applying corresponding demagnetization current to each demagnetization coil, so that the three-direction demagnetization sequence of each layer of shielding bodies is X-Y-Z, X-Z-Y, Y-X-Z, Y-Z-X, Z-X-Y and Z-Y-X.

The above technical solution adopted by the present invention has the following advantages: the present invention provides the demagnetization method for the multilayer shielding apparatus, which realizes demagnetization based on the demagnetization coil system; the plurality of turns of demagnetization coils are arranged in the demagnetization coil system in layers; the corresponding demagnetization currents can be applied for different layers and different directions, to avoid the problem of unsaturated or supersaturated shielding bodies caused by sharing demagnetization coils; and meanwhile, in the method, all layers of shielding bodies are demagnetized layer by layer from inside to outside, and then demagnetized layer by layer from outside to inside, to reduce the magnetic field interference when different layers of shielding bodies are demagnetized. Compared with the existing demagnetization methods, the method provided by the present invention can effectively improve the demagnetization effect, significantly reduce the residual static magnetic field inside the shielding apparatus, and play an important role of supporting the researches on biomagnetism, basic physics experiment, aeromagnetic detection, geomagnetic anomaly detection and the like performed by adopting the shielding apparatus.

DESCRIPTION OF THE DRAWINGS

FIG. 2A-FIG. 2B are schematic diagrams of a curve of the change of a demagnetizing magnetic field corresponding to a linear attenuation demagnetization current and a curve of the internal magnetization of the shielding materials in the embodiment of the present invention; wherein, FIG. 2A is a schematic diagram of a curve of the change of the demagnetizing magnetic field provided by the linear attenuation demagnetization current with time; and FIG. 2B is a schematic diagram of a curve of the demagnetization of the corresponding shielding materials;

FIG. 3A is a schematic diagram of the change of demagnetizing magnetic field intensity with time in the same magnetic flux circuit caused by linear attenuation demagnetization current with different initial magnitudes; and FIG. 3B is a schematic diagram of the change of magnetic induction intensity corresponding to FIG. 3A.

FIGS. 4A-FIG. 4D are schematic diagrams of the change of the demagnetizing magnetic field intensity with time caused by different types of demagnetization currents; wherein FIG. 4A is a schematic diagram of the changes of the magnetic field intensity with time corresponding to the linear attenuation demagnetization current and the second-order attenuation demagnetization current;

FIG. 4B is a schematic diagram of the changes of magnetic induction intensity with time corresponding to the linear attenuation demagnetization current and the second-order attenuation demagnetization current; FIG. 4C is a schematic diagram of a curve of the change of magnetic field intensity corresponding to the exponential attenuation demagnetization current when the parameter b in the exponential function is 4 and 7; and FIG. 4D is a schematic diagram of a curve of the change of the magnetic induction intensity corresponding to the exponential attenuation demagnetization current when the parameter b in the exponential function is 4 and 7;

FIG. 5A-FIG. 5D are schematic diagrams of the change of the demagnetization current, the demagnetizing magnetic field intensity and the magnetic induction intensity with time when the inner layer is demagnetized before the outer layer; wherein, FIG. 5A shows the changes of the demagnetization currents of the inner layer and the outer layer with time; FIG. 5B shows the changes of the demagnetizing magnetic field intensities of the inner layer and the outer layer with time; FIG. 5C shows the change of the magnetic induction intensity of the inner layer with time; and FIG. 5D shows the change of the magnetic induction intensity of the outer layer with time.

Figure 1:
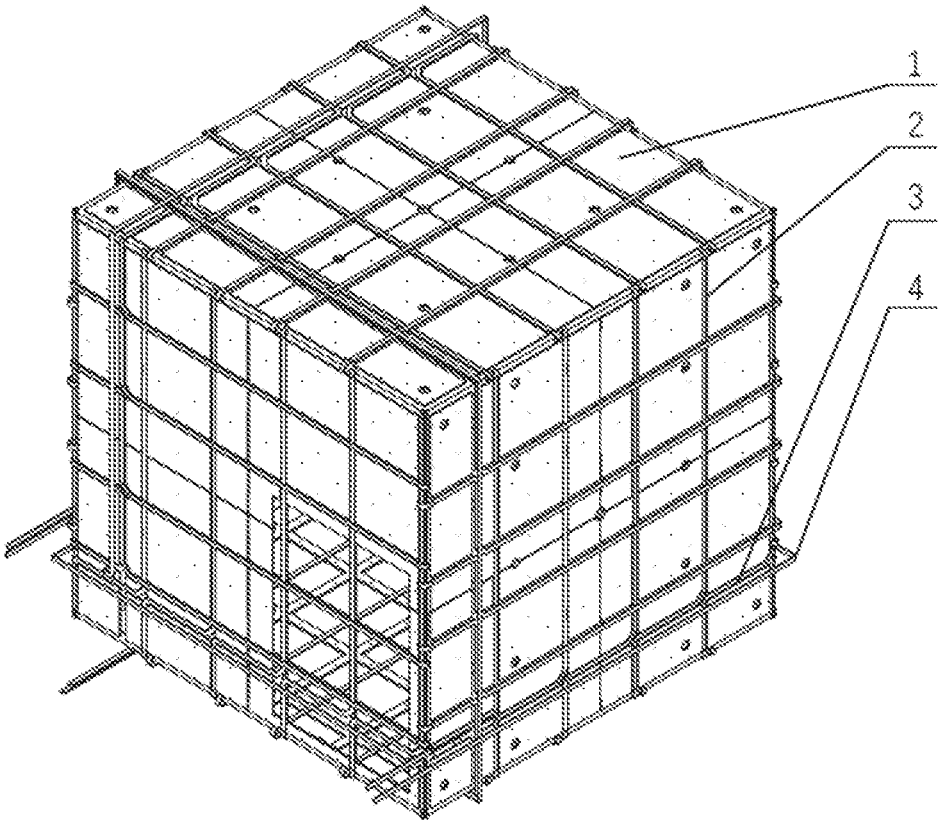
FIG. 1 is a schematic diagram of a (partial) coil winding structure of a multilayer shielding apparatus and a demagnetization coil system in an embodiment of the present invention.

In the figures, 1: shielding body; 2: demagnetization coil; 3: current outgoing circuit connection wire; 4: current returning circuit connection wire; 10: controller; 11: D/A converter; 12: voltage divider; 13: low-pass filter; 14: power amplifier; 15: transformer; and 16: relay.

DETAILED DESCRIPTION OF PREFERRED EMBODIMENTS

To make the purpose, the technical solutions and advantages of the embodiments of the present invention more clear, the technical solutions in the embodiments of the present invention will be clearly and fully described below in combination with the drawings in the embodiments of the present invention. Apparently, the described embodiments are merely part of the embodiments of the present invention, not all of the embodiments. Based on the embodiments in the present invention, all other embodiments obtained by those ordinary skilled in the art without contributing creative labor will belong to the protection scope of the present invention.

As shown in FIGS. 1-7, embodiments of the present invention provide a demagnetization method for a multilayer shielding apparatus. In the demagnetization method, the demagnetization is realized on the basis of a demagnetization coil system, which comprises a plurality of turns of demagnetization coils 2, a plurality of connection wires and a power supply module.

A multilayer shielding apparatus comprises at least two layers of shielding bodies 1; the shielding bodies 1 are made of shielding materials and are of a hollow structure; all layers of shielding bodies 1 are sleeved layer by layer from inside to outside; and the shielding bodies 1 on the outer layer are larger than the shielding bodies 1 on the inner side thereof. A plurality of turns of demagnetization coils 2 are wound on each layer of shielding bodies 1 at intervals; one half of each turn of demagnetization coils is located inside the wound shielding bodies, and the other half is located outside the wound shielding bodies, for providing a corresponding demagnetizing magnetic field to form a closed magnetic flux circuit. Each demagnetization coil 2 is wound with one layer and winds only one layer of shielding body 1, thereby avoiding the situation that one demagnetization coil 2 wind two or more layers of shielding bodies 1 at the same time.

Wire holes are formed at the positions where threading is required on the shielding bodies 1; and the specific position of each wire hole can be set according to the structure of the shielding body 1, preferably near the edge or at the center of the shielding surface, so that the wound demagnetization coil 2 can cover the whole shielding surface as much as possible to realize uniform demagnetization. The demagnetization coil 2 can be formed by winding with a copper wire with an insulating layer, and is not further defined here.

Each demagnetization coil 2 is connected to the power supply module through the corresponding connection wire, so that the demagnetization coil 2 is applied with a corresponding demagnetization current. A single demagnetization coil 2 generates a demagnetizing magnetic field after the demagnetization current is applied; a resultant demagnetizing magnetic field generated by the plurality of demagnetization coils 2 forms a magnetic flux circuit surrounding the shielding apparatus; and the magnetic flux circuit has a central axis.

The power supply module comprises a controller which is connected with each connection wire and used for generating and sending corresponding control instructions according to user input to control each demagnetization coil 2 to be applied with a corresponding demagnetization current. The demagnetization can be controlled more accurately and effectively by the controller.

The demagnetization method comprises: applying the corresponding demagnetization current to each demagnetization coil 2, so that each layer of shielding bodies 1 are demagnetized layer by layer from inside to outside, and then demagnetized layer by layer from outside to inside; and the intensity of demagnetization current is set according to the size of each layer of shielding bodies 1. Namely, all demagnetization coils 2 are grouped according to the layers of the shielding bodies 1 where the demagnetization coils are located; the plurality of turns of demagnetization coils 2 arranged on the innermost layer of shielding bodies 1 are first applied with the corresponding demagnetization current for demagnetizing the innermost layer of shielding bodies 1; then, the demagnetization current is applied into the plurality of turns of demagnetization coils 2 on a following outer layer of shielding bodies 1; and next, the demagnetization current is applied to the plurality of turns of demagnetization coils 2 on a following outer layer of shielding bodies 1, and so on until the corresponding demagnetization current is applied to the plurality of turns of demagnetization coils 2 on the outermost layer of shielding bodies 1, for demagnetization of the outermost layer of shielding bodies 1 to complete the step of demagnetizing layer by layer from inside to outside in the demagnetization method. Then, the step of demagnetizing layer by layer from outside to inside is performed in a reverse order. Namely, the demagnetization current is first applied to the plurality of turns of demagnetization coils 2 on the outermost layer of shielding bodies 1 for demagnetizing the outermost layer of shielding bodies 1; and the shielding bodies are demagnetized layer by layer from outside to inside until the demagnetization current is first applied to the plurality of turns of demagnetization coils 2 on the innermost layer of shielding bodies 1 for demagnetizing the outermost layer of shielding bodies 1, to finally demagnetize the shielding bodies 1.

In the demagnetization method for the multilayer shielding apparatus provided by the present invention, the demagnetization coils 2 are arranged in layers in the demagnetization coil system; different layers of shielding bodies 1 do not share the demagnetization coil 2; and the corresponding demagnetization current can be applied to each layer of shielding bodies 1 during demagnetization, to avoid the situation of unsaturated or supersaturated shielding bodies 1 when the shielding bodies 1 share the demagnetization coil 2 and use the same demagnetization current.

Meanwhile, the problem of mutual influence of demagnetizing magnetic fields among different layers of shielding bodies 1 is considered in the demagnetization method. When the shielding bodies on the inner layer are demagnetized, not only the shielding bodies on the inner layer are in an alternating magnetic field, but also the shielding bodies on the outer layer are affected, and vice versa. A magnetic flux circuit of the shielding bodies on the outer layer is larger than that of the shielding bodies on the inner layer. When the shielding bodies on the outer layer are demagnetized, the magnetic field is more easily attracted by the shielding bodies on the inner layer, so the shielding bodies on the inner layer are more seriously affected. For the shielding bodies sleeved in a plurality of layers, the present invention proposes to first demagnetize layer by layer from inside to outside, and then demagnetize layer by layer from outside to inside, which can realize a demagnetization effect more stable than other demagnetization sequences. Compared with the general demagnetization methods, the demagnetization method provided by the present invention can greatly improve the demagnetization effect and maximally reduce the static magnetic field in the shielding apparatus, to meet the requirements of weak magnetic field signal detection and other applications on the nonmagnetic environment.

Preferably, the demagnetization current applied to the demagnetization coil 2 is linear attenuation demagnetization current, second-order attenuation demagnetization current or exponential attenuation demagnetization current.

Further, an envelope function expression of the linear attenuation demagnetization current is:

$$I_E = I_M\left(1 - \frac{tf_D}{n}\right)$$

where $I_M$ refers to a demagnetization current that allows the demagnetizing magnetic field in the direction to be saturated; $f_D$ refers to an alternating current frequency; and n refers to the number of alternating cycles.

Figure 2A:
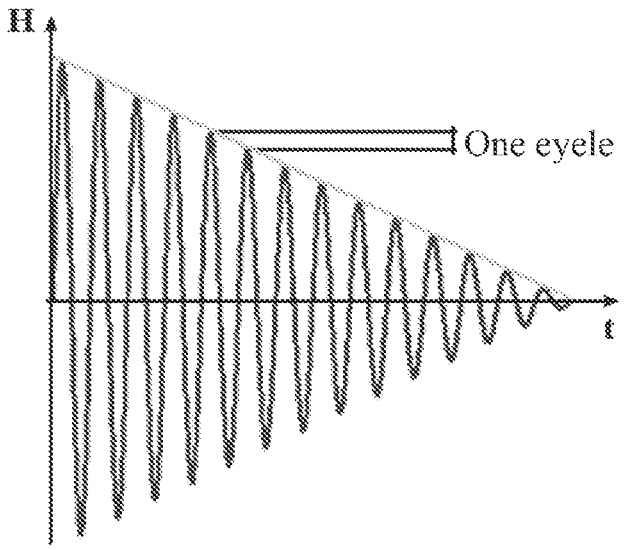
Figure 2B:
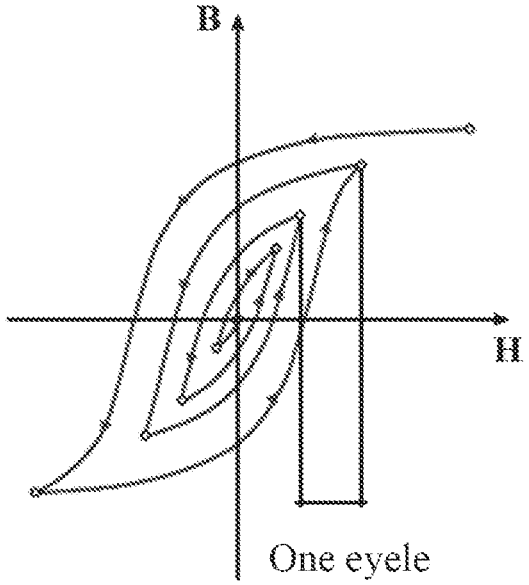

Please refer to FIG. 2A-FIG. 2B; FIG. 2A is a schematic diagram of a curve of the change of the demagnetizing magnetic field provided by the linear attenuation demagnetization current with time; FIG. 2B is a schematic diagram of a curve of the demagnetization of the corresponding shielding materials; the horizontal axis represents a demagnetizing magnetic field H; and the vertical axis represents the magnetic induction intensity B inside the materials. When demagnetization is performed, an AC demagnetization current with gradually decreasing magnitude is applied to the demagnetization coil, so the shielding body materials will bear a gradually decreasing AC demagnetizing magnetic field. The shielding bodies are magnetized repeatedly with the magnetic field; the magnetic induction intensity will approach to zero in a vortex manner with the change of hysteresis circuit; and when the demagnetizing magnetic field decreases to zero, the magnetization intensity and the magnetic induction intensity of the shielding body materials will also approach zero. The amplitude of the demagnetizing magnetic field is determined by the magnitude of the demagnetization current and the size of the shielding apparatus; and to achieve the best demagnetization effect, the initial value of the demagnetizing magnetic field should enable the shielding bodies to be saturated. For example, for permalloy-type shielding body materials, the internal magnetic induction intensity should be about 0.6-0.8 T. For a specific shielding apparatus, an appropriate initial value of demagnetization current should be applied according to the specific size of shielding bodies and the shielding materials. The demagnetization currents can adopt different waveforms, and have a decline rule determined by the envelope function. Different demagnetization effects can be achieved by controlling the envelope function of demagnetization current applied to the demagnetization coil 2, i.e., adopting demagnetization currents with different waveforms, such as AC current with linearly decreased magnitude, AC current with second-order rate attenuated magnitude and AC current with exponentially decreased magnitude.

Figure 3A:
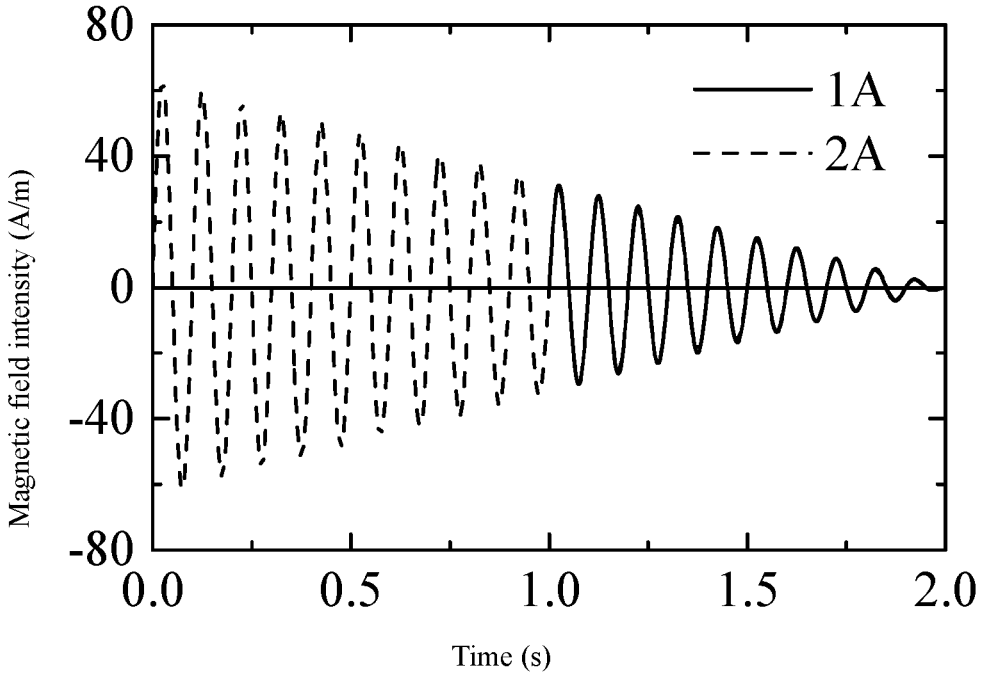
FIG. 3A-FIG. 3B are schematic diagrams of the change of demagnetizing magnetic field intensity and magnetic induction intensity with time caused by linear attenuation demagnetization currents with different initial magnitudes in the same magnetic flux circuit.
Figure 3B:
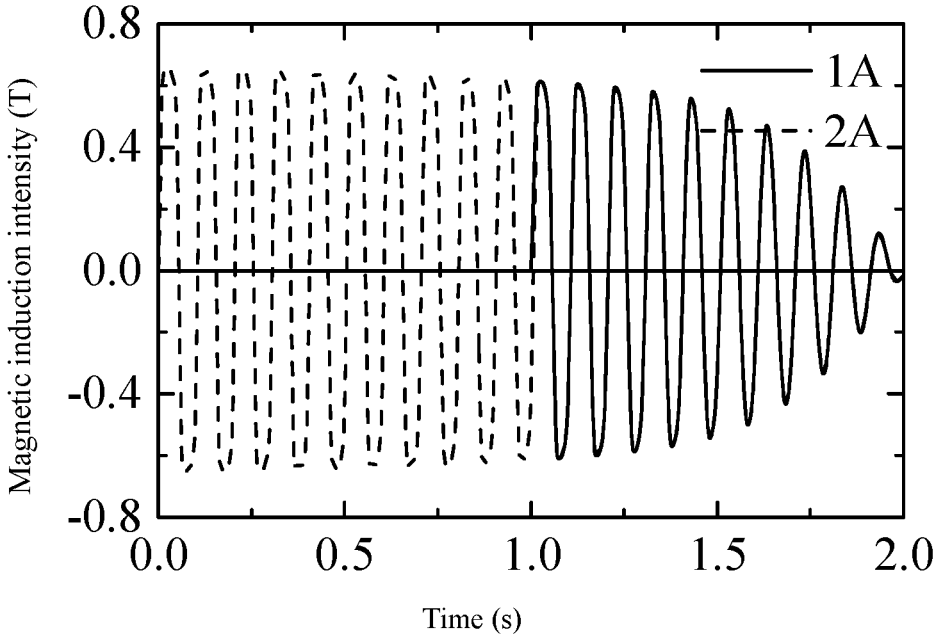

When different demagnetization initial currents are applied to the same demagnetization coil 2, the initial amplitudes of attenuation of demagnetizing magnetic field intensity are also different; and the initial values of the corresponding magnetic induction intensity may be quite different due to the nonlinear characteristics of the shielding body materials. Taking the situation shown in FIG. 3A-FIG. 3B as an example, FIG. 3A is a schematic diagram of the change of demagnetizing magnetic field intensity with time in the same magnetic flux circuit caused by linear attenuation demagnetization current with different initial magnitudes; and FIG. 3B is a schematic diagram of the change of magnetic induction intensity corresponding to FIG. 3A. When the demagnetization current is doubled, the magnetic induction intensity is supersaturated, so that only half of the 20 demagnetization cycles are effective, and a vortex demagnetization curve gradually approaching to zero can be formed. Therefore, the demagnetization coils 2 with different layers and directions should be controlled independently and applied with different demagnetization currents to realize effective demagnetization when the magnetic circuits have different magnetic reluctances.

At the initial demagnetization stage, although the demagnetizing magnetic field decreases linearly, the shielding body materials are in a saturated stage, and the magnetic induction intensity inside the materials attenuates slowly. At the final demagnetization stage, the magnetic induction intensity of materials decreases rapidly. The above rule is also shown in FIGS. 3(*a*) and 3(*b*). Although the magnetic field intensity decreases linearly, the magnetic induction intensity does not decrease linearly. Demagnetization is a process of repeatedly magnetizing the magnetic domain of materials and gradually reducing the degree of magnetization. At present, the demagnetization current and the demagnetizing magnetic field caused by the demagnetization current generally decrease with time according to a linear law in the prior art. Due to the nonlinear characteristics of shielding materials, such a linear demagnetizing magnetic field makes the corresponding magnetic induction intensity decrease slowly for a long period of time, but decrease rapidly before the demagnetization is about to end, so the optimal demagnetization effect cannot be achieved.

To prolong the effective reduction time of the magnetic induction intensity, the present invention also proposes to change the linear envelope function of demagnetization current to other kinds of functions. Preferably, the present invention proposes two novel demagnetization currents: the second-order attenuation demagnetization current and the exponential attenuation demagnetization current, to accelerate the attenuation speed of the demagnetizing magnetic field intensity, so that the attenuation speed of the demagnetization induction intensity is relatively consistent in the whole demagnetization process.

Further, the envelope function expression of the second-order attenuation demagnetization current with a second-order attenuated envelop is:

$$I_E = I_M\left(\frac{tf_D}{n} - 1\right)^2$$

where $I_M$ refers to the demagnetization current that allows the demagnetizing magnetic field in the direction to be saturated; $f_D$ refers to the alternating current frequency; and n refers to the number of alternating cycles. Compared with linear attenuation demagnetization current, the second-order attenuation demagnetization current has a different demagnetization effect.

Figure 4A:
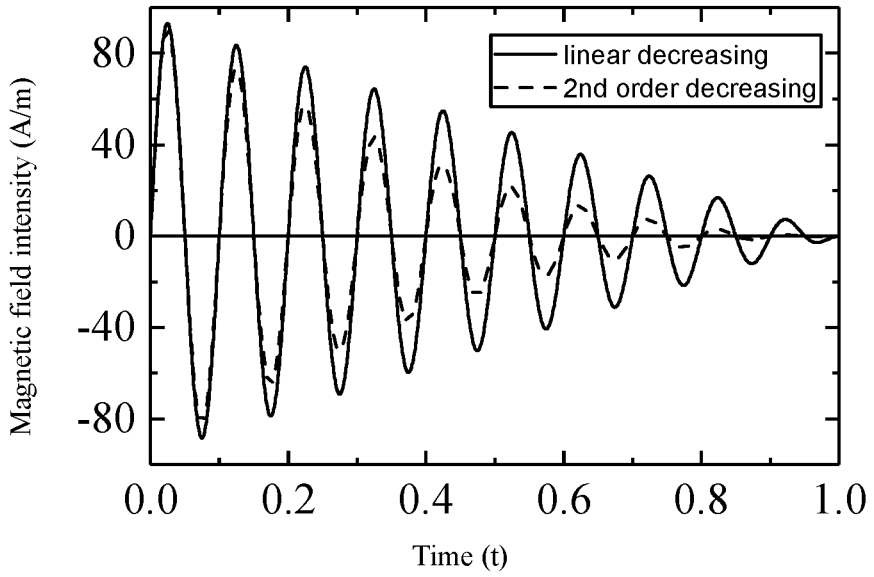
Figure 4B:
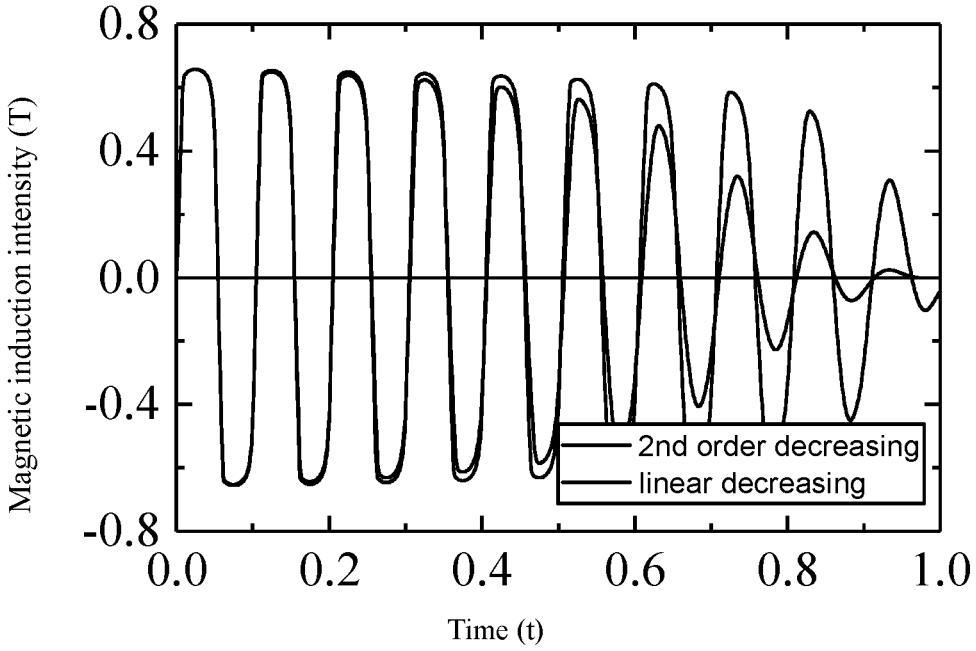

FIG. 4A-FIG. 4D are schematic diagrams of the changes of the demagnetizing magnetic field intensity and the magnetic induction intensity with time caused by different types of demagnetization currents; FIG. 4A is a schematic diagram of the changes of the magnetic field intensity with time corresponding to the linear attenuation demagnetization current and the second-order attenuation demagnetization current; and FIG. 4B is a schematic diagram of the changes of magnetic induction intensity with time corresponding to the linear attenuation demagnetization current and the second-order attenuation demagnetization current. FIGS. 4(*a*) and 4(*b*) show that, compared with the linear attenuation demagnetization current, the magnetic induction intensity of the second-order attenuation demagnetization current has the following characteristics: the saturated stage is short at the initial demagnetization stage, the decreasing speed at a middle demagnetization stage is reasonable, and the amplitude at the final demagnetization stage is gradually reduced within a small range, so that the final residual magnetic induction intensity is reduced.

Figure 4C:
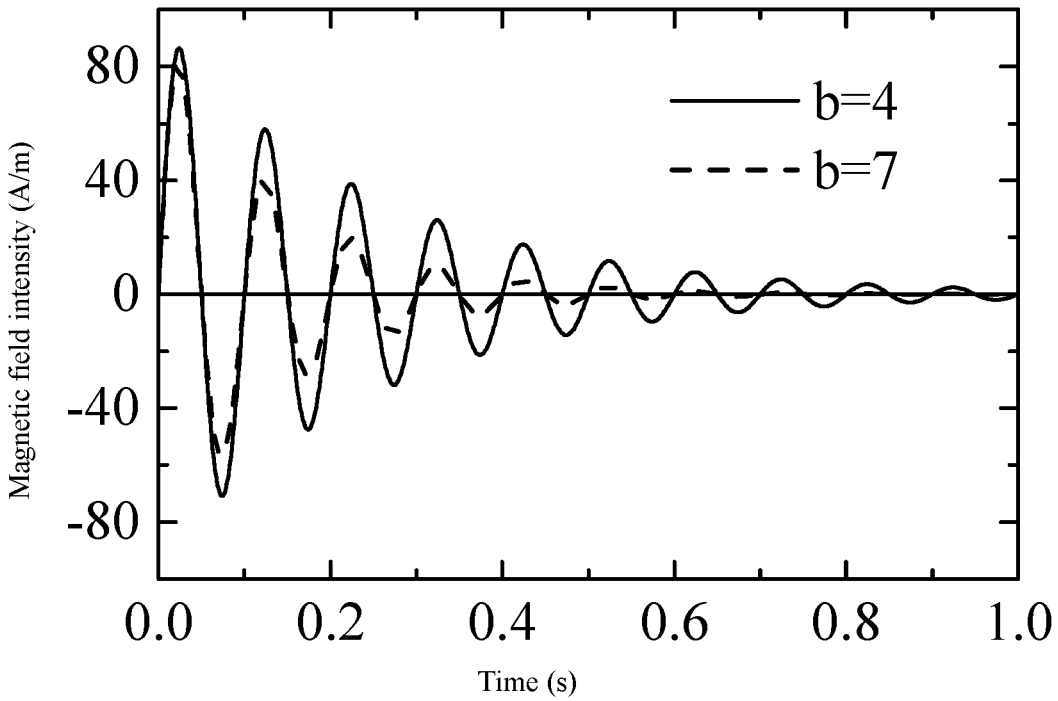
Figure 4D:
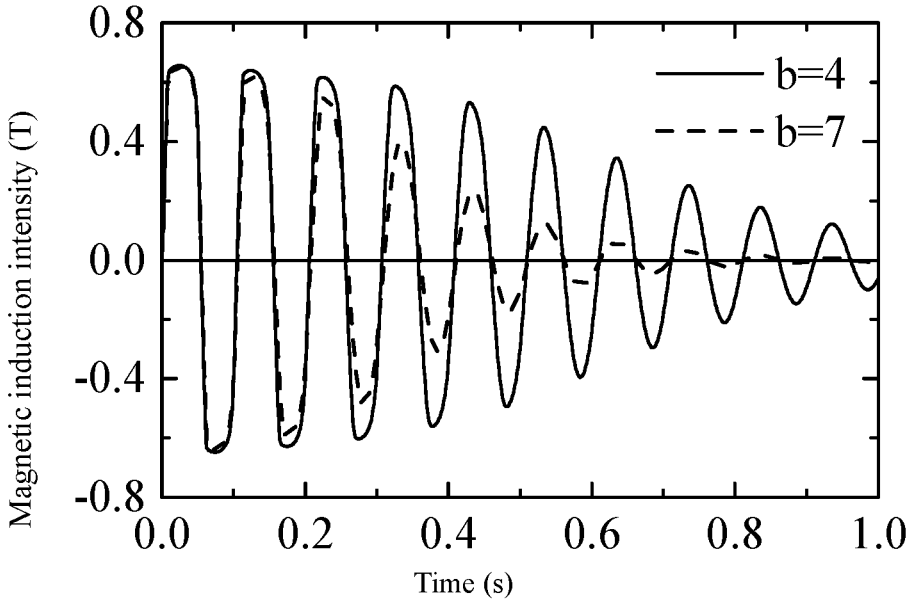

The envelop function expression of the exponential attenuation demagnetization current with an exponentially attenuated envelop is:

$$I_E = I_M e^{-b\frac{tf_D}{n}}$$

where $I_M$ refers to a demagnetization current that allows the demagnetizing magnetic field in the direction to be saturated; $f_D$ refers to an alternating current frequency; n refers to the number of alternating cycles; and b refers to an adjustment parameter for adjusting the decreasing speed of exponential attenuation. FIG. 4C is a schematic diagram of a curve of the change of magnetic field intensity corresponding to the exponential attenuation demagnetization current when the parameter b in the exponential function is 4 and 7; and FIG. 4D is a schematic diagram of a curve of the change of the magnetic induction intensity corresponding to the exponential attenuation demagnetization current when the parameter b in the exponential function is 4 and 7. The parameter b represents the decreasing speed. When b continues to increase, i.e., the demagnetization current decreases faster, the residual magnetic induction intensity is gradually increased. The reason is that the demagnetizing magnetic field decreases too fast, so that the saturated stage in the initial demagnetization stage and the steady decreasing stage in the middle demagnetization stage are too short, and some magnetic domains fail to reverse quickly by following the demagnetizing magnetic field. Therefore, the parameters of the exponential demagnetization envelope function should be set according to the applied shielding apparatus and the adopted demagnetization system.

Preferably, a plurality of turns of demagnetization coils 2 are uniformly wound on each shielding surface of each layer of shielding bodies 1 at intervals. As shown in FIG. 1, the demagnetization coils 2 are uniformly distributed on the whole shielding surface at intervals, i.e., the demagnetization coil system is of a distributed demagnetization coil structure, which can generate a more uniform demagnetizing magnetic field, so that soft magnetic materials throughout the shielding apparatus are demagnetized fully and uniformly. Compared with the centralized demagnetization coil structure in which the demagnetization coils 2 are only arranged at the intersection of two shielding surfaces, the uniformity of the demagnetizing magnetic field borne by the shielding apparatus is significantly improved by applying the same demagnetization current. The uniform distribution at intervals comprises uniform distribution at intervals in a width direction, length direction, height direction or circumferential direction of the shielding surface (when the wire hole of the shielding surface is arranged at the center of the shielding surface, correspondingly, the demagnetization coils 2 can be uniformly distributed at intervals in the circumferential direction of the shielding surface).

Figure 5A:
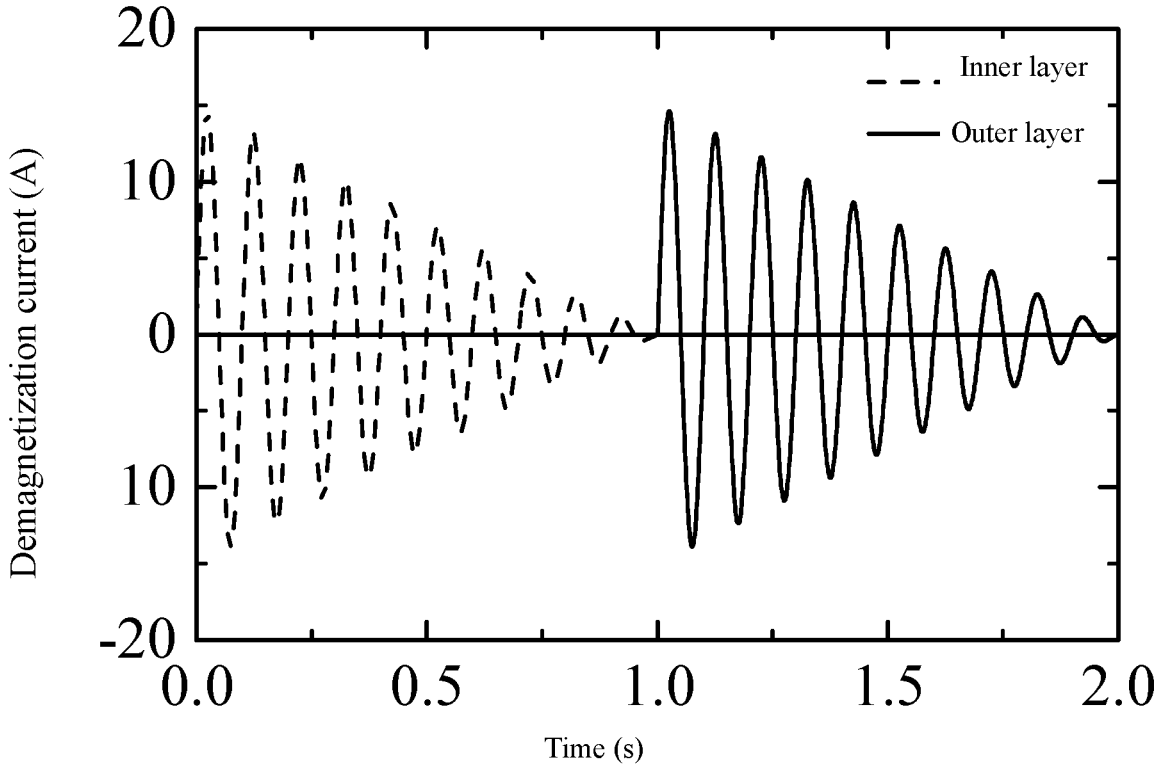
Figure 5B:
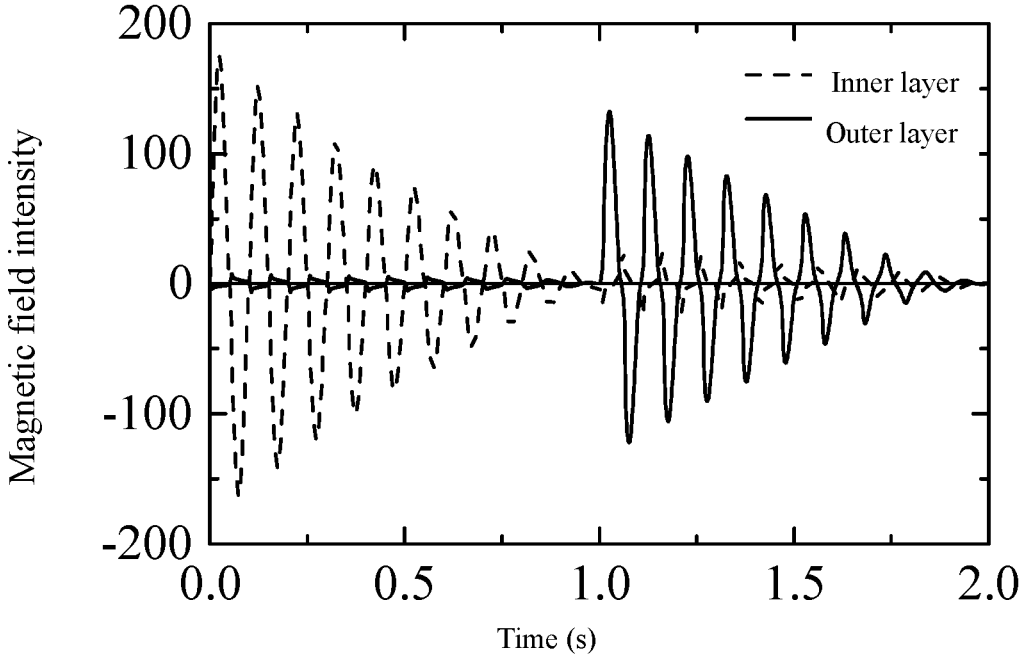
Figure 5C:
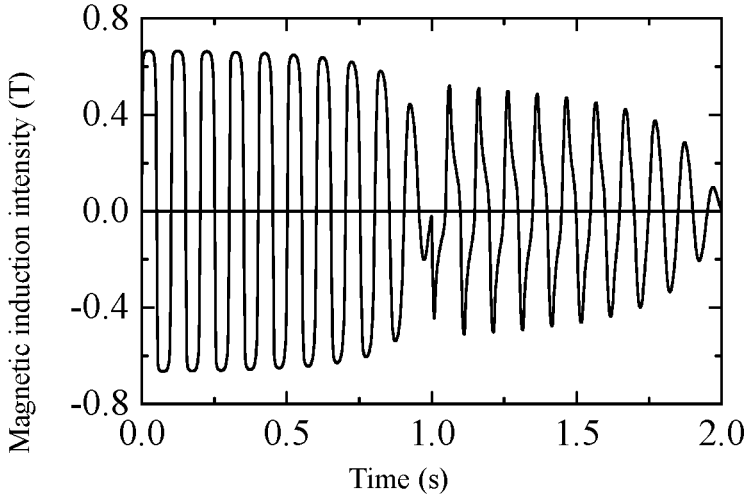
Figure 5D:
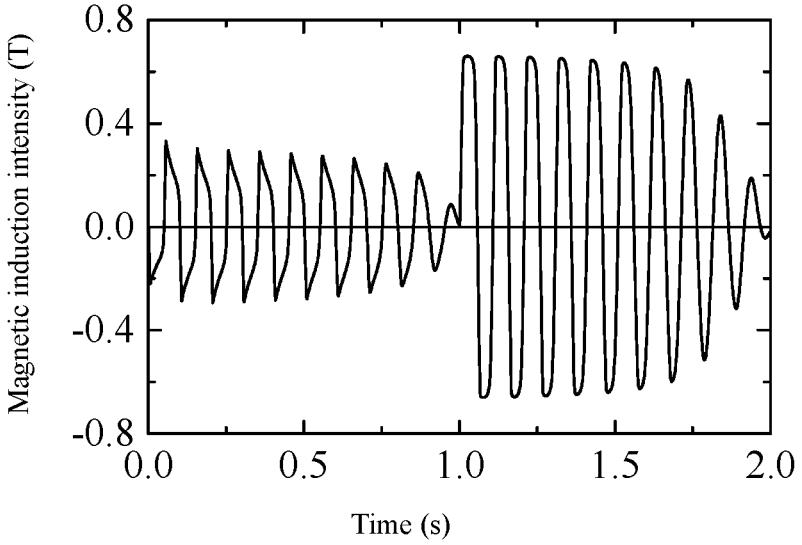

Please refer to FIG. 5A-FIG. 5D, which are schematic diagrams of changes of the demagnetization current, the demagnetizing magnetic field intensity and the magnetic induction intensity with time when the demagnetization coil system is of the distributed demagnetization coil structure, and the shielding apparatus comprises two shielding bodies on the inner layer and the outer layer. FIG. 5A shows the changes of the demagnetization currents of the inner layer and the outer layer with time; FIG. 5B shows the changes of the demagnetizing magnetic field intensities of the inner layer and the outer layer with time; FIG. 5C shows the change of the magnetic induction intensity of the inner layer with time; and FIG. 5D shows the change of the magnetic induction intensity of the outer layer with time.

Figure 6:
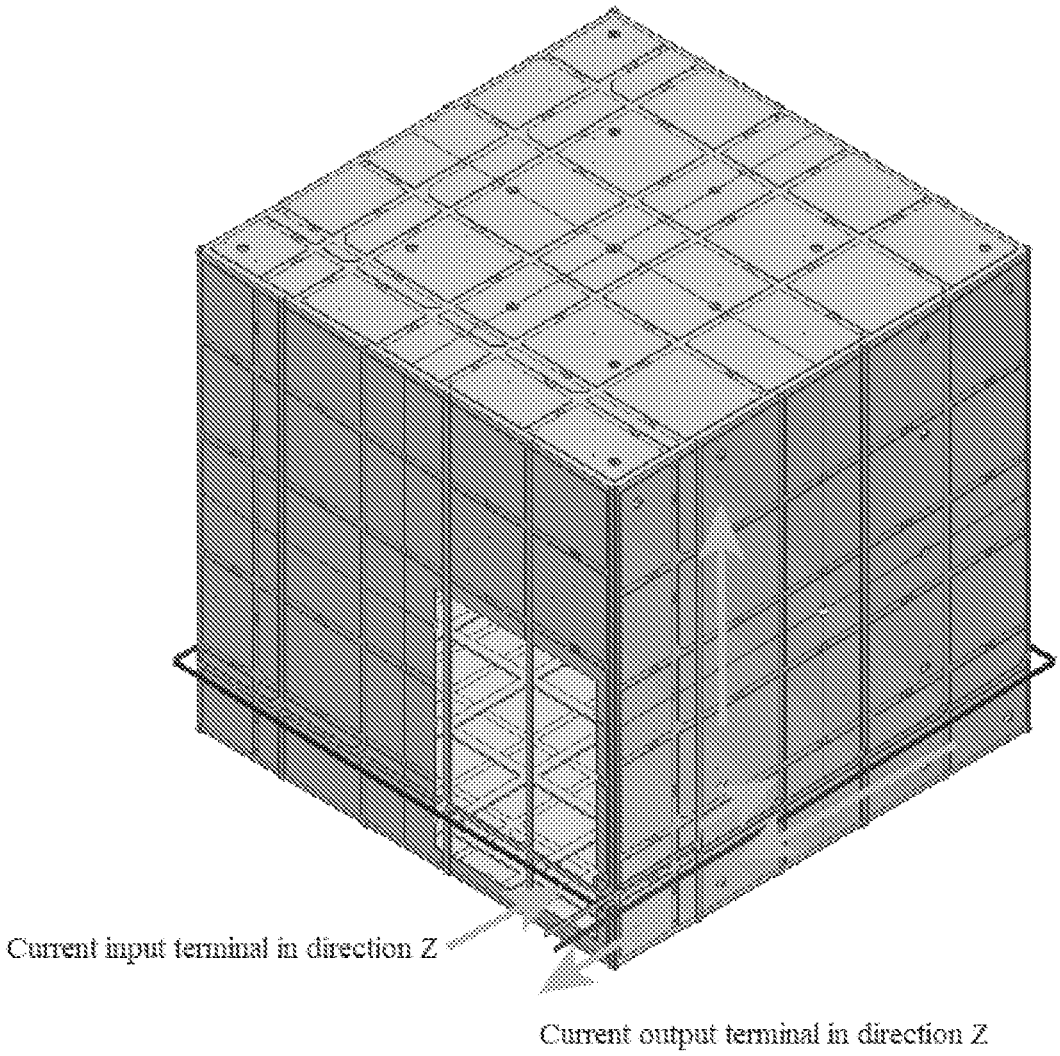
FIG. 6 is a schematic diagram of a magnetic interference-free coil connection mode (i.e., the connection wire arrangement mode) of the demagnetization coil system in the embodiment of the present invention.

Preferably, each connection wire is folded back. As shown in FIGS. 1 and 6, half of each connection wire is a current outgoing circuit connection wire 3 which is connected with the corresponding demagnetization coil 2; and the other half is a current returning circuit connection wire 4 which is folded back along the original circuit in reverse, i.e., an outgoing circuit and a returning circuit of the connection wire are parallel to each other and are basically the same in route. Two open ends formed by folding the connection wire, i.e., one end of the current outgoing circuit connection wire and one end of the current returning circuit connection wire, are connected to the power supply module, so that the connected demagnetization coils 2 are applied with the demagnetization currents, and then the demagnetization coils 2 can generate corresponding demagnetizing magnetic fields as required. The demagnetization coils 2 connected to the same connection wire are powered synchronously. After one turn of demagnetization coil 2 is wound, one shielding surface of a layer of shielding bodies 1 is connected to the next demagnetization coil 2 through the connection wire; and the current in the connection wire between the two turns of demagnetization coils 2 will generate an interfering magnetic field other than the target demagnetizing magnetic field, so the other half of the connection wire are folded back along the original circuit of the first half of the connection wire, so that the returning circuit and the outgoing circuit of demagnetization current of each connection wire are parallel to each other, and the magnetic fields generated by the two currents offset and compensate each other, thereby avoiding generating the interfering magnetic field other than the demagnetizing magnetic field to ensure the demagnetization effect.

Preferably, the control instructions generated by the controller comprise digital waveforms corresponding to the demagnetization currents. Parameters such as frequency and magnitude of the demagnetization currents applied into the demagnetization coil system can be changed by the controller, to precisely and automatically control the demagnetization current and avoid errors caused by manual operation.

Figure 7:
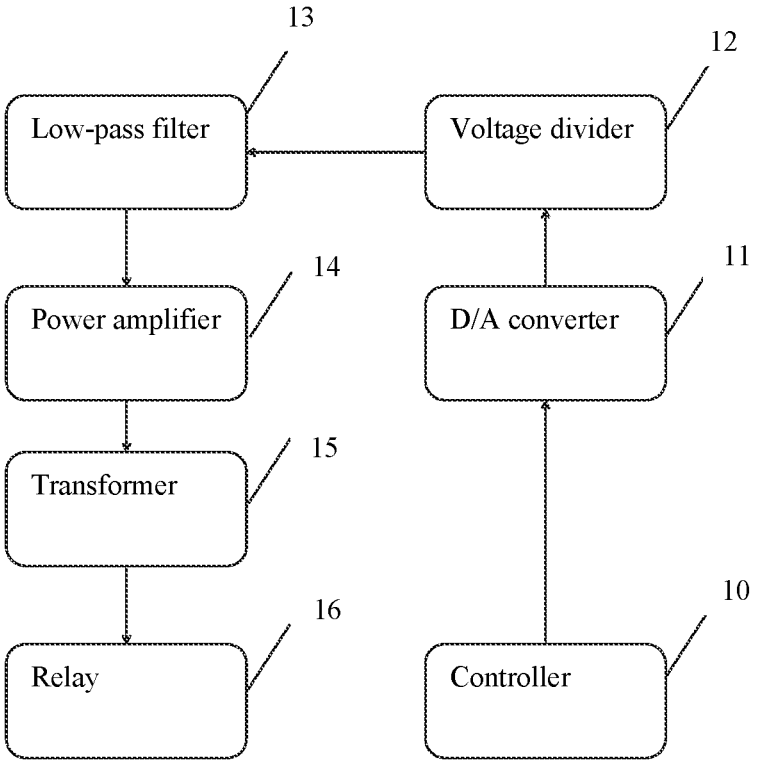
FIG. 7 is a structural block diagram of a power supply module of the demagnetization coil system in the embodiment of the present invention.

Further, as shown in FIG. 7, the power supply module further comprises a D/A converter 11, a voltage divider 12, a low-pass filter 13, a power amplifier 14, a transformer 15 and a relay 16. The control instructions generated by the controller 10 comprise the digital waveforms corresponding to the demagnetization currents; namely, the controller 10 is used for generating the programmable digital waveforms of the demagnetization currents according to the user input. The D/A converter 11 is connected with the controller 10 and is used for receiving the digital waveforms and converting the digital waveforms into analog signals; and the digital waveforms are changed into the analog signals by the D/A converter 11 for power amplification. The voltage divider 12 is connected with the D/A converter 11 and is used for receiving the analog signals and adjusting the amplitudes. The amplitudes of the analog signals can be adjusted by the voltage divider 12 within the maximum input signal range of the power amplifier 14, to make full use of the precision of the D/A converter 11. The low-pass filter 13 is connected with the voltage divider 12 and is used for receiving the analog signals with adjusted amplitudes and filtering the high-frequency interference signals therein to filter out the high-frequency interference signals. The power amplifier 14 is connected with the low-pass filter 13 and is used for receiving the filtered analog signals and outputting high-power demagnetization currents. The transformer 15 is connected with the power amplifier 14 and is used for receiving the high-power demagnetization current and filtering out the DC bias of the demagnetization current, to prevent the demagnetization process from magnetizing the shielding apparatus instead. The relay 16 is connected with the transformer 15 and the connection wire, and is used for controlling the on-off state of the corresponding demagnetization coil 2 to change the demagnetization sequence. The demagnetization current provided by the power supply module is injected into the demagnetization coil 2, in which the connection terminal is a nonmagnetic terminal, and finally a demagnetizing magnetic field is generated. The power amplifier 14 should adopt a current source operating mode, to ensure that the current in the demagnetization coil 2 is directly controlled by the control signal, i.e., the demagnetizing magnetic field is directly controlled.

In some preferred embodiments, the shielding bodies 1 are of a hollow cuboid structure (comprising a cube structure) with six planar shielding surfaces. To accurately control the demagnetization curve of the shielding materials, it should be ensured that the materials are just saturated in the initial period because the remanence Br of the material cannot be completely eliminated due to unsaturation, while the number of effective demagnetization cycles within limited demagnetization time is reduced due to super-saturation. For the cube structure, the demagnetizing magnetic fields formed by the demagnetization coils in three directions X, Y and Z have the magnetic flux circuits equal in length, corresponding to the same magnetic resistance, so the same demagnetization current produces the same magnetic induction intensity in the shielding materials. However, for the cuboid structure, the magnetic flux circuits in the three directions X, Y and Z are different; and in general, if the demagnetization currents in the directions X, Y and Z are not distinguished and controlled by the same demagnetization current, the problem of inconsistent demagnetization of the shielding materials will be caused again. Therefore, the present invention proposes a method for independently controlling the multilayer three-direction demagnetization coils 2 (separately controlling the demagnetization coils in different layers and directions), to determine the initial magnitude of the demagnetization current according to the length of each magnetic flux circuit.

Figure 8:
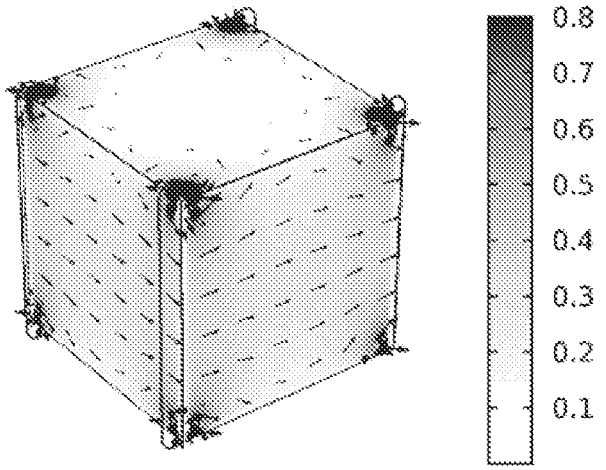
FIG. 8 is a schematic diagram of the distribution of the demagnetizing magnetic field generated by demagnetization in a direction Z of a centralized demagnetization coil structure in a single-layer cube shielding body.
Figure 9:
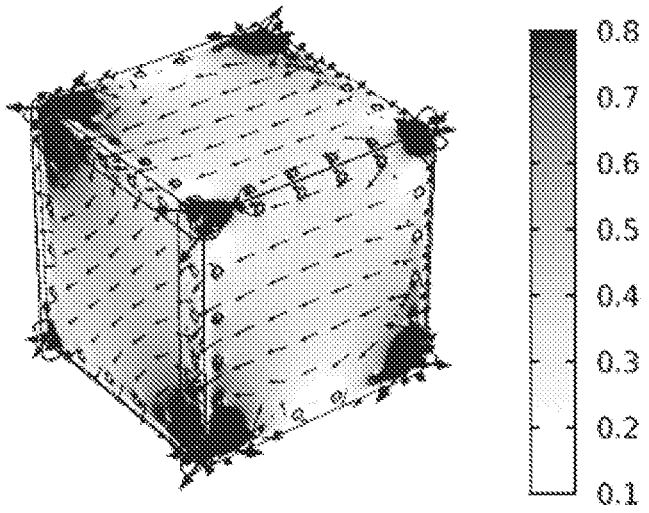
FIG. 9 is a schematic diagram of the distribution of the demagnetizing magnetic field generated by simultaneous demagnetization in both directions X and Z of the centralized demagnetization coil structure in the single-layer cube shielding body.
Figure 10:
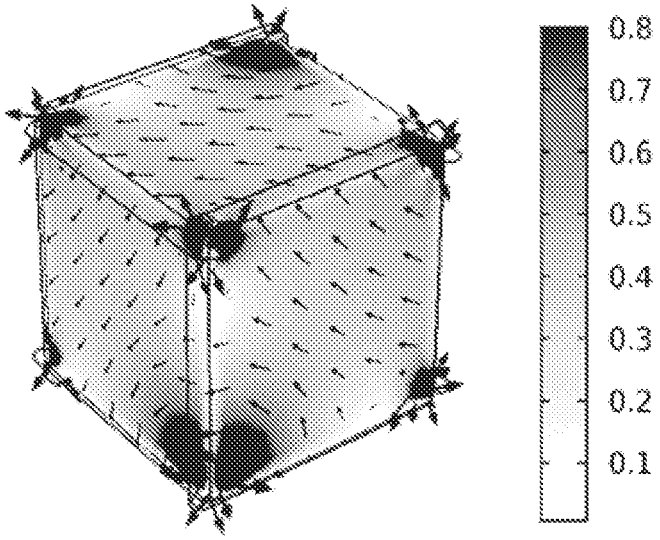
FIG. 10 is a schematic diagram of the distribution of demagnetizing magnetic field generated by simultaneous demagnetization in three directions X, Y and Z of the centralized demagnetization coil structure in the single-layer cube shielding body.

In some embodiments, as shown in FIGS. 8-10 (where the unit of color gradation is the unit T of magnetic induction intensity), the demagnetization coil system may be of a centralized demagnetization coil structure; the demagnetization coil 2 is wound at an intersection of two shielding surfaces of one layer of shielding bodies 1; and one turn of demagnetization coil is arranged at the intersection of any two planar shielding surfaces, i.e., each demagnetization coil is only arranged at twelve edges of each shielding body 1, not on the shielding surface. All turns of demagnetization coils wound at the intersection of four planar shielding surfaces arranged in any direction are distributed in parallel at intervals to form a magnetic flux circuit corresponding to the direction; and the corresponding demagnetization coils on six planar shielding surfaces form a magnetic flux circuit with three orthogonal directions. As shown in FIG. 8, four demagnetization coils corresponding to the direction Z are distributed in parallel at intervals, for generating magnetic flux flowing on four sides, thereby forming a magnetic flux circuit with the central axis in the direction Z. However, the magnetic field is not uniformly distributed on the four surfaces. Particularly, strong interfering magnetic fields are generated in eight corners of the top and bottom surfaces, so the above position cannot be demagnetized effectively.

For the centralized demagnetization coil, the demagnetizing magnetic fields in three directions should be separately demagnetized. FIG. 9 shows the distribution of demagnetizing magnetic fields generated by simultaneous demagnetization in both directions X and Z of the centralized demagnetization coil structure. FIG. 10 shows the distribution of demagnetizing magnetic fields generated by simultaneous demagnetization in three directions X, Y and Z of the centralized demagnetization coil structure. Apparently, a strong supersaturated magnetic field region is caused at the corner of the shielding body, and cannot be effectively demagnetized; and due to the remanence of the materials, the amplitude of the magnetic field inside the shielding apparatus cannot be reduced to near zero, and the gradient of the magnetic field is relatively high. Preferably, in the present invention, for the demagnetization coil system with a centralized structure, the demagnetization method further comprise the step of applying the corresponding demagnetization current into each demagnetization coil, so that the demagnetization sequence of each layer of shielding bodies in three directions is X-Y-Z, X-Z-Y, Y-X-Z, Y-Z-X, Z-X-Y and Z-Y-X, i.e., the demagnetization sequence of a single layer of shielding bodies 1 in three directions is preferably X-Y-Z, X-Z-Y, Y-X-Z, Y-Z-X, Z-X-Y and Z-Y-X.

Normally, the magnetic circuits of the magnetic field in the direction Y do not pass through a shield door, but the magnetic circuits of the magnetic field in the directions X and Y all pass through the shield door. Generally, the overlapping joint of the magnetic circuits of the shielding materials on the shield door and walls is different from that in other positions, or the overlapping joint is insufficient, to result in a greater magnetic resistance; or more overlapping joint materials are designed to compensate for magnetic leakage, resulting in more materials to be demagnetized than other positions. Therefore, the demagnetization in the directions X and Z is unlikely to be achieved perfectly in general; and the demagnetization effect is determined by the specific shielding apparatus.

Figure 11:
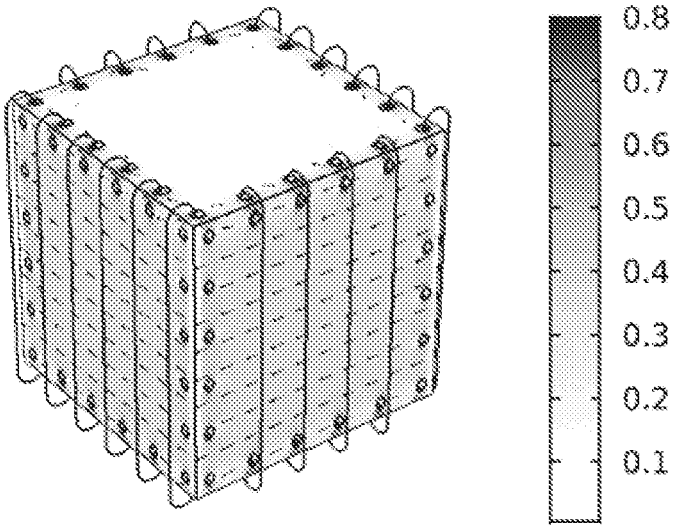
FIG. 11 is a schematic diagram of the distribution of the demagnetizing magnetic field generated by demagnetization in the direction Z of a distributed demagnetization coil structure in the single-layer cube shielding body.
Figure 12:
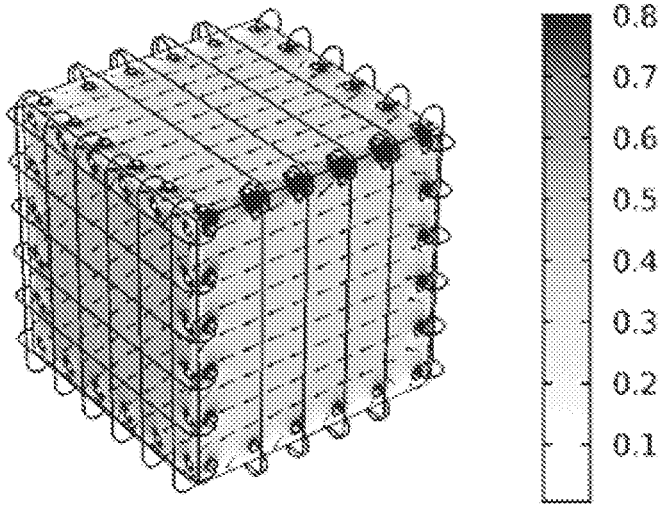
FIG. 12 is a schematic diagram of the distribution of the demagnetizing magnetic field generated by simultaneous demagnetization in both directions X and Z of the distributed demagnetization coil structure in the single-layer cube shielding body.
Figure 13:
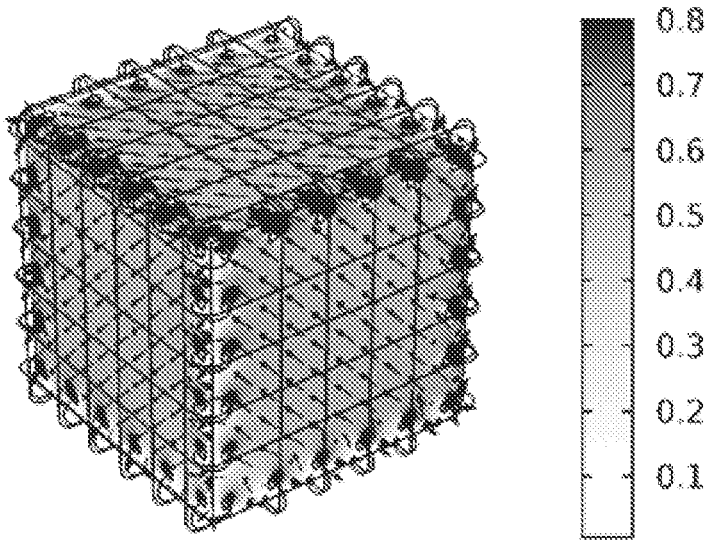
FIG. 13 is a schematic diagram of the distribution of the demagnetizing magnetic field generated by simultaneous demagnetization in three directions X, Y and Z of the distributed demagnetization coil structure in the single-layer cube shielding body.

In other embodiments, the demagnetization coil system can also be of a distributed demagnetization coil structure; as shown in FIGS. 11-13 (where the unit of color gradation is the unit T of magnetic induction intensity), a plurality of turns of demagnetization coils are uniformly wound on six planar shielding surfaces of the shielding body at intervals; and all turns of demagnetization coils 2 wound on four planar shielding surfaces arranged in any direction are distributed in parallel at intervals to form a magnetic flux circuit corresponding to the direction. As shown in FIG. 11, among the six planes of the cube, two groups of opposite planes (four planes in total) with normals perpendicular to the directions X and Y are all arranged along the direction Z; the four planes are all wound with a plurality of turns of demagnetization coils 2 arranged in parallel at intervals; and the demagnetizing magnetic field generated correspondingly forms a magnetic flux circuit of the central axis along the direction Z. Each shielding surface is wound with two groups of demagnetization coils 2 corresponding to different directions (the central axes of the magnetic flux circuits are in different directions); and all the corresponding demagnetization coils 2 on the six planar shielding surfaces can form a magnetic flux circuit with three orthogonal directions. Namely, the resultant demagnetizing magnetic fields generated by the plurality of demagnetization coils 2 form a magnetic flux circuit surrounding the shielding apparatus; the magnetic flux circuit has a central rotation axis; and the demagnetization coils 2 of all six shielding surfaces can generate three kinds of demagnetizing magnetic fields with rotation axes X, Y and Z, respectively.

For the distributed demagnetization coil structure, preferably, the demagnetization method also comprises a step of applying a corresponding demagnetization current into each demagnetization coil, so that each layer of shielding bodies are demagnetized simultaneously in three directions, i.e., a single layer of shielding bodies 1 are demagnetized simultaneously in three directions during demagnetization, and the plurality of turns of demagnetization coils 2 arranged corresponding to three directions are simultaneously applied with corresponding demagnetization currents. FIGS. 12 and 13 respectively show the distribution of demagnetizing magnetic fields generated by simultaneous demagnetization of the distributed demagnetization coil structure in two directions X and Z and in three directions X, Y and Z. Apparently, compared with the centralized demagnetization coil structure, the problem of super-saturation in some regions is significantly weakened.

The present invention proposes simultaneous demagnetization in three directions for the distributed demagnetization coil structure, so that on the one hand, the time required for demagnetization is reduced to one third of the original demagnetization time; and on the other hand, the interference of demagnetization in different directions can be avoided well because the shielding materials on all sides of the same shielding body will be demagnetized at the same time, i.e., the problem of interference of demagnetization in a certain direction to the shielding materials on the remaining two sides no longer exists, thereby achieving the best demagnetization effect. As shown in FIG. 13, due to the simultaneous applying of demagnetization currents in three directions, the amplitude of demagnetizing magnetic field generated under the condition of unsaturated magnetic field is $\sqrt{2}$ times that of the original single-direction demagnetizing magnetic field; and to keep the same amplitude of demagnetizing magnetic field, the demagnetization current can be reduced to $1/\sqrt{2}$ times of the original set value. In the case of sequential demagnetization, the power consumed by demagnetization in three directions is $P=3\times I^2R$. In the case of simultaneous demagnetization in three directions, the consumed power is $P=3\times(I/\sqrt{2})^2R$ and reduced to half of the original power. Especially, when the shielding body is cuboid (non-cube) and the demagnetization is performed in three directions simultaneously, the magnitude of the demagnetization current should be increased to the extent that the longest magnetic flux circuit can also be saturated, and then the demagnetization time should be prolonged in equal proportion, to achieve the effect of simultaneous demagnetization of the cube.

The specific number and positions of the demagnetization coils 2 in the shielding apparatus can be comprehensively set according to the specific size, material and structure of the shielding apparatus. For the demagnetization coil system with the hollow cuboid structure and the distributed demagnetization coil structure, preferably, to obtain better demagnetization effect, the interval between two adjacent turns of parallel demagnetization coils 2 wound on any shielding surface should not be greater than ⅓, preferably not greater than ⅕ of the vertical dimension of the shielding surface along the two turns of demagnetization coils 2; the vertical dimension is the size of the shielding surface in the vertical coil direction. If all turns of demagnetization coils 2 are arranged in parallel at intervals along a length direction of the shielding surface, and the length direction is perpendicular to each demagnetization coil 2, the length is the size of the shielding surface in the vertical coil direction, and the distance between two adjacent demagnetization coils 2 is not greater than ⅓ of the length of the shielding surface. Similarly, if all turns of demagnetization coils 2 are arranged in parallel at intervals along a width direction of the shielding surface, the distance between two adjacent demagnetization coils 2 should not be greater than ⅓ of the width.

Preferably, all turns of demagnetization coils 2 wound on the same planar shielding surface are connected with the same connection wire; and further, all turns of demagnetization coils 2 corresponding to the same direction (i.e., the central axes of the formed magnetic flux circuits are in the same direction) are connected with the corresponding connection wires in series to realize synchronous demagnetization in the same direction. Namely, firstly, all demagnetization coils 2 on each planar shielding surface are connected as a group; then, all demagnetization coils 2 on four shielding surfaces arranged along the direction Z are connected as a group, and the same is true for the directions X and Y; and finally, two terminals for current input and output are available. The connection circuit can be simplified by the above connection mode; and the mode of mounting coils is simpler in practical engineering.

The demagnetization method provided by the present invention is also verified on the basis of some specific multilayer shielding apparatuses; and it is proved that the demagnetization method provided by the present invention can obtain extremely low internal residual static magnetic field. A shielding room composed of two layers of permalloy shielding bodies and one layer of aluminum shielding bodies has internal dimensions of 2.78 m in length, 2.5 m in width and 2.35 m in height, and a quasi-static magnetic field shielding coefficient of about 300. In the environment with an earth magnetic field of about 50 μT, the external magnetic field can be shielded to 50 μT/300, i.e., the internal static magnetic field is about 167 nT. After demagnetization by the demagnetization method provided by the present invention, the amplitude of the internal static magnetic field is measured to be less than 2 nT by a fluxgate magnetic sensor. The shielding room composed of three layers of permalloy shielding bodies and one layer of aluminum shielding bodies has internal dimensions of 1.85 m in length, 1.85 m in width and 1.85 m in height, and a quasi-static magnetic field shielding coefficient of about 5,000. In the environment with the earth magnetic field of about 50 μT, the external magnetic field can be shielded to 50 μT/5,000, i.e., the internal static magnetic field is about 10 nT. After demagnetization by the demagnetization method provided by the present invention, the amplitude of the internal static magnetic field is measured to be less than 130 pT by a superconducting quantum interference device (SQID). The magnetic field environment is lower than that in the published papers or public reports so far.

Figure 14:
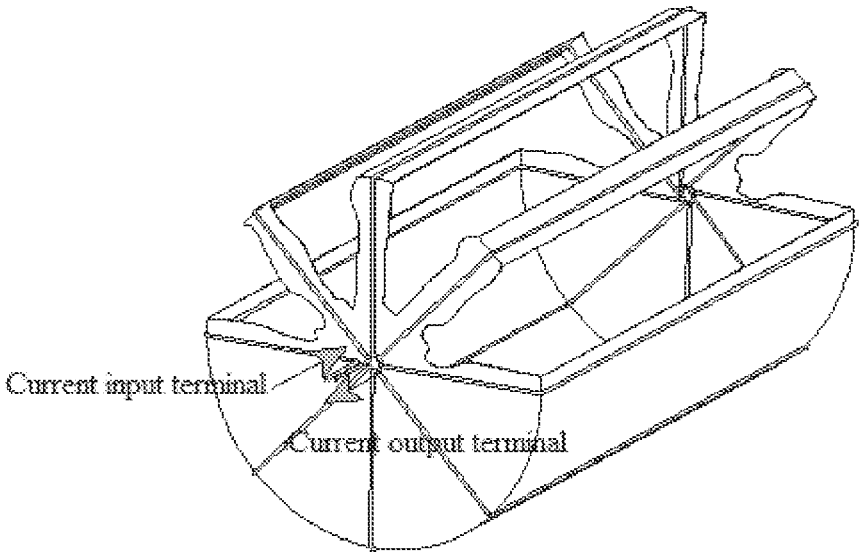
FIG. 14 is a schematic diagram of a (partial) coil winding structure of another multilayer shielding apparatus and demagnetization coil system in the embodiment of the present invention.

As shown in FIG. 14, in other embodiments, the shielding bodies 1 can also be of a hollow cylinder structure, which has an arc-shaped shielding surface and two planar circular shielding surfaces; a plurality of turns of demagnetization coils are uniformly distributed on the arc-shaped shielding surface; and all turns of demagnetization coils are distributed in parallel at intervals along the circumferential direction of the cylinder, to form the demagnetizing magnetic field with the central axis of the magnetic flux circuit along a central symmetrical axis of the cylinder. A plurality of turns of demagnetization coils are also uniformly distributed on the upper and lower planar circular shielding surfaces; and each turn of demagnetization coils are distributed at intervals along the circumferential direction of the wound planar circular shielding surface, i.e., wire holes are formed in the center and edge of the planar circular shielding surface; and each turn of demagnetization coils are arranged along the radial direction of a circle and distributed around the center of the circle, to also form the demagnetizing magnetic field with the central axis of the magnetic flux circuit along the central symmetrical axis of the cylinder. Particularly, the demagnetization coils on the arc-shaped shielding surface may or may not be connected with the demagnetization coils on the planar circular shielding surfaces.

In conclusion, the demagnetization method for the multilayer shielding apparatus provided by the present invention is realized on the basis of the demagnetization coil system; and the demagnetization coil system may be of a centralized or distributed structure, so that the demagnetization currents with any waveform can be applied. The waveform of demagnetization currents can be changed by defining the envelope functions of the demagnetization currents, to increase the number of effective demagnetization cycles within the limited demagnetization time. The time sequence of demagnetization by applying demagnetization currents into the demagnetization coils can be adjusted to reduce the interference among a plurality of layers of shielding bodies and the interference among a plurality of directions, and to finally realize the deep demagnetization of the shielding apparatuses. The demagnetization method provided by the present invention has wide application range, convenient operation, high precision and good demagnetization effect.

Finally, it should be noted that the above embodiments are only used for describing the technical solution of the present invention rather than limitation. Although the present invention is described in detail by referring to the above embodiments, those ordinary skilled in the art should understand that: the technical solution recorded in each of the above embodiments can be still amended, or some technical features therein can be replaced equivalently. However, these amendments or replacements do not enable the essence of the corresponding technical solution to depart from the spirit and the scope of the technical solution of various embodiments of the present invention.

We claim:

1. A demagnetization method for a multilayer shielding apparatus, wherein demagnetization is realized by the demagnetization method on the basis of a demagnetization coil system; the demagnetization coil system comprises a plurality of turns of demagnetization coils, a plurality of connection wires and a power supply module;

the multilayer shielding apparatus comprises at least two layers of shielding bodies; all the layers of shielding bodies are sleeved layer by layer from inside to outside; a plurality of turns of demagnetization coils are wound on each layer of shielding bodies at intervals; one half of each turn of demagnetization coils is located inside the wound shielding bodies, and the other half is located outside the wound shielding bodies, for providing corresponding demagnetizing magnetic fields to form a closed magnetic flux circuit; each demagnetization coil is connected to the power supply module through the corresponding connection wire; and the power supply module comprises a controller which is connected with each connection wire and used for generating and sending corresponding control instructions according to user input to control each demagnetization coil to be applied with a corresponding demagnetization current;

the demagnetization method comprises: applying a corresponding demagnetization current to each demagnetization coil, so that all layers of shielding bodies are demagnetized layer by layer from inside to outside, and then demagnetized layer by layer from outside to inside, wherein the intensity of demagnetization current is set according to the size of each layer of shielding bodies.

2. The demagnetization method according to claim 1, wherein the demagnetization current applied to the demagnetization coil is linear attenuation demagnetization current, second-order attenuation demagnetization current or exponential attenuation demagnetization current.

3. The demagnetization method according to claim 2, wherein the envelope function expression of the linear attenuation demagnetization current is:

$$I_E = I_M\left(1 - \frac{tf_D}{n}\right)$$

where $I_M$ refers to a demagnetization current that allows the demagnetizing magnetic field in the direction to be saturated; $f_D$ refers to an alternating current frequency; and n refers to the number of alternating cycles;

the envelope function expression of the second-order attenuation demagnetization current is:

$$I_E = I_M\left(\frac{tf_D}{n} - 1\right)^2$$

where $I_M$ refers to the demagnetization current that allows the demagnetizing, magnetic field in the direction to be saturated; $f_D$ refers to the alternating current frequency; and n refers to the number of alternating cycles;

the envelope function expression of the exponential attenuation demagnetization current is:

$$I_E = I_M e^{-b\frac{tf_D}{n}}$$

where $I_M$ refers to a demagnetization current that allows the demagnetizing magnetic field in the direction to be saturated; $f_D$ refers to an alternating current frequency; n refers to the number of alternating cycles; and b refers to an adjustment parameter for adjusting the decreasing speed of exponential attenuation;

the current intensity expression of the demagnetization current applied to the demagnetization coil is:

$$I = I_E \sin(2\pi f_D t).$$

4. The demagnetization method according to claim 1, wherein a plurality of turns of demagnetization coils are uniformly wound on each shielding surface of each layer of shielding bodies at intervals.

5. The demagnetization method according to claim 4, wherein each connection wire is folded back; one half of each connection wire is a current outgoing circuit connection wire which is connected with each corresponding demagnetization coil; the other half is a current returning circuit connection wire which is folded back along the original circuit in reverse; and both the current outgoing circuit connection wire and the current returning circuit connection wire are connected to the power supply module, so that the demagnetization current is applied to all the connected demagnetization coils.

6. The demagnetization method according to claim 1, wherein the control instruction generated by the controller comprises a digital waveform corresponding to the demagnetization current;

the power supply module further comprises:

a digital-to-analog (D/A) converter, which is connected with the controller and used for receiving the digital waveform and converting the digital waveform into an analog signal;

a voltage divider, which is connected with the D/A converter and used for receiving the analog signal and adjusting the amplitude of the analog signal;

a low-pass filter, which is connected with the voltage divider and used for receiving the analog signal with adjusted amplitude and filtering a high-frequency interference signal therein;

a power amplifier, which is connected with the low-pass filter and used for receiving the filtered analog signal and outputting a high-power demagnetization current;

a transformer, which is connected with the power amplifier and used for receiving the high-power demagnetization current and filtering direct-current (DC) bias of the demagnetization current; and a relay, which is connected with the transformer and the connection wires and used for controlling an on-off state of the corresponding demagnetization coil.

7. The demagnetization method according to claim 4, wherein each shielding body is, of a hollow cuboid structure with six planar shielding surfaces, on which a plurality of turns of demagnetization coils are uniformly wound at intervals; all turns of demagnetization coils wound on four planar shielding surfaces arranged along any direction are distributed in parallel at intervals to form a magnetic flux circuit corresponding to the direction; and the corresponding demagnetization coils on the six planar shielding surfaces form a magnetic flux circuit with three orthogonal directions.

8. The demagnetization method according to claim 7, wherein the demagnetization method further comprises:

applying corresponding demagnetization current to each demagnetization coil, so that each layer of shielding bodies is demagnetized simultaneously in three directions.

9. The demagnetization method according to claim 1, wherein each shielding body is of a hollow cuboid structure with six planar shielding surfaces; the demagnetization coil is wound around an intersection of two planar shielding surfaces of the shielding body; one turn of the demagnetization coil is arranged at any intersection of two planar shielding surfaces; all turns of demagnetization coils wound at the intersection of four planar shielding surfaces arranged in any direction are distributed in parallel at intervals to form a magnetic flux circuit corresponding to the direction; and the corresponding demagnetization coils on the six planar shielding surfaces form a magnetic flux circuit with three orthogonal directions.

10. The demagnetization method according to claim 9, wherein the demagnetization method further comprises:

applying corresponding demagnetization current to each demagnetization coil, so that the three-direction demagnetization sequence of each layer of shielding bodies is X-Y-Z, X-Z-Y, Y-X-Z, Y-Z-X, Z-X-Y and Z-Y-X.

* * * * *